United States Patent [19]

Morton

[11] Patent Number: 5,016,503

[45] Date of Patent: May 21, 1991

[54] ADJUSTABLE OPEN END WRENCH

[76] Inventor: Carlyle D. Morton, 1447 Lynn St., Erie, Pa. 16503

[21] Appl. No.: 542,806

[22] Filed: Jun. 25, 1990

Related U.S. Application Data

[63] Continuation of Ser. No. 386,000, Jul. 27, 1989, abandoned, which is a continuation of Ser. No. 226,440, Aug. 1, 1988, abandoned.

[51] Int. Cl.[5] ..... B25B 13/12

[52] U.S. Cl. ..... 81/127; 81/126; 81/128

[58] Field of Search ..... 181/127, 126, 128

[56] References Cited

U.S. PATENT DOCUMENTS

| | | | |
|---|---|---|---|
| 52,930 | 2/1866 | Morehouse | 81/127 |
| 77,107 | 4/1868 | Searle | 81/127 |
| 516,286 | 3/1894 | Wachtler | 81/127 |
| 1,075,516 | 10/1913 | Sturdy | 81/127 |
| 1,092,152 | 4/1914 | Lebombarb | 81/127 |
| 1,178,287 | 4/1916 | Anderson | 81/127 |
| 1,181,654 | 1/1916 | Eifel | 81/126 |
| 1,253,227 | 1/1918 | Gaisser | 81/127 |
| 2,590,792 | 3/1952 | Reneer | 81/127 |
| 3,803,954 | 4/1974 | Lenker | 81/127 |
| 4,094,215 | 6/1978 | Hudson | 81/127 |

FOREIGN PATENT DOCUMENTS

| | | | |
|---|---|---|---|
| 0935418 | 11/1955 | Fed. Rep. of Germany | 81/127 |
| 0538206 | 6/1922 | France | 81/127 |

*Primary Examiner*—Frederick R. Schmidt
*Assistant Examiner*—Lawrence Cruz
*Attorney, Agent, or Firm*—Ralph Hammar

[57] ABSTRACT

This invention is an open end wrench which is self-adjusting and ratcheting, which clamps a nut with a force greater than the nut turning force exerted on the wrench handle and which fits an entire range of nut sizes.

6 Claims, 7 Drawing Sheets

AMERICAN STANDARD
BOLTS AND NUTS

METRIC

ADJUSTABLE OPEN END WRENCH

This application is a continuation of Ser. No. 07/386,000 filed 07/27/89, now abandoned, which is a continuation of Ser. No. 07/226,440 filed 06/01/86, now abandoned.

This invention is an open end wrench which is self-adjusting and ratcheting, which clamps a nut with a force greater than the nut turning force exerted on the wrench handle and which fits an entire range of nut sizes, for example, nuts for quarter inch to half inch bolts. This range has heretofore been covered by two sets of open end wrenches, one metric and the other English.

Figure 1:
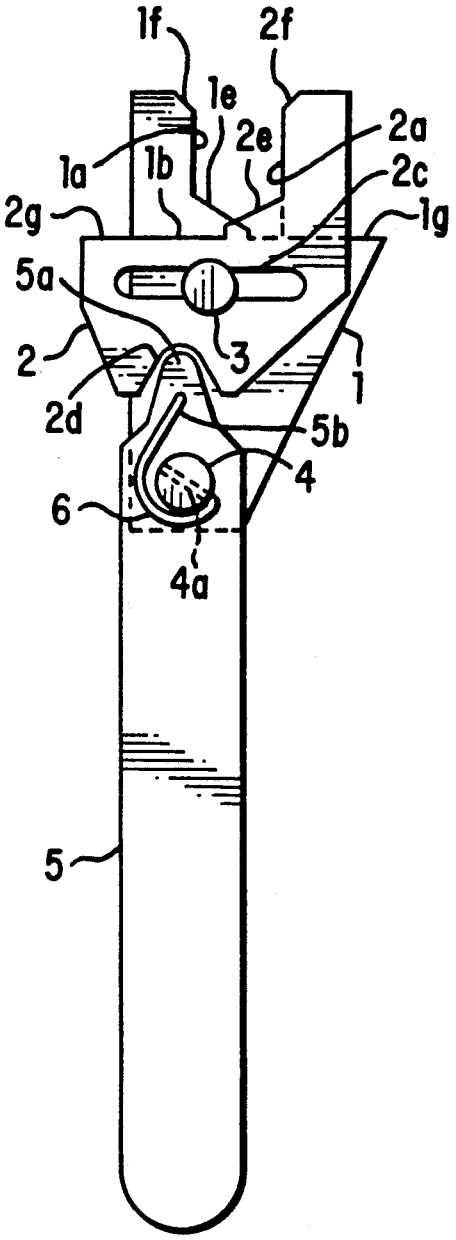
FIG. 1 is a view of a wrench.
Figure 2:
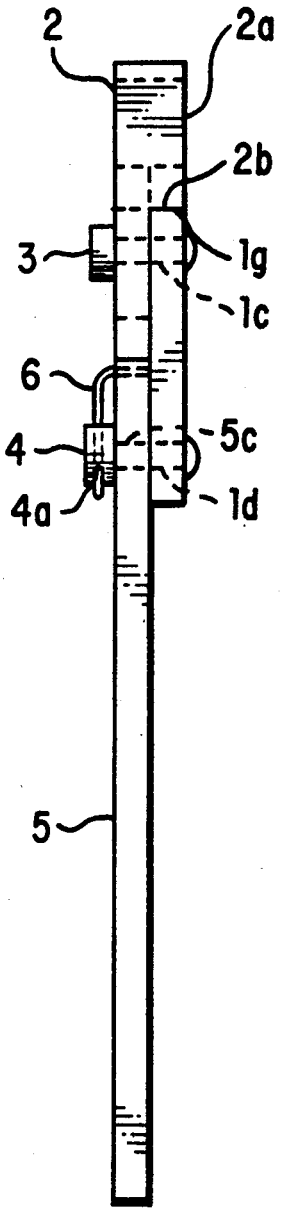
FIG. 2 is an edge view of FIG. 1.
Figure 3:
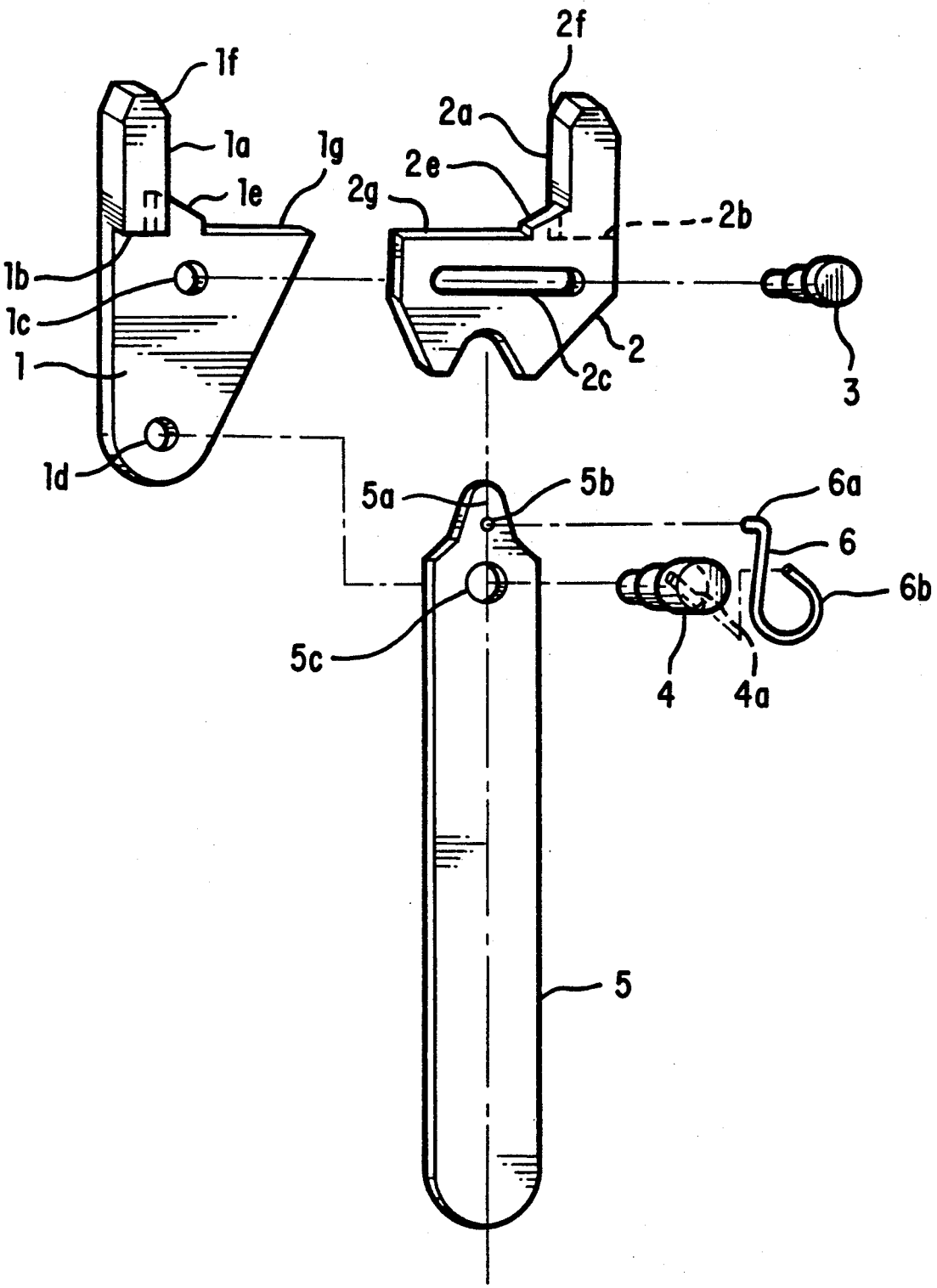
FIG. 3 is an exploded view of the parts of the FIG. 1 wrench.

The parts of the wrench consist of main jaw 1, sliding jaw 2, shoulder pin 3, shoulder pin 4, handle 5 and spring 6.

Main jaw 1 has a thickened nut gripping section 1*a*, a guide surface 1*b* presented to and engaging guide surface 2*b* on jaw 2, a hole 1*c* in which shoulder pin 3 is fixed to hold the jaws together, a hole 1*d* in which shoulder pin 4 is fixed to pivot the handle 5 on jaw 1, an inclined surface 1*e* which cooperates with an inclined surface 2*e* to locate the lowermost point of a hexagonal nut clamped between gripping surfaces 1*a* and 2*a* and chamfer 1*f* to assist in mounting the wrench on a nut.

The jaw members have generally flat portions which lie one on top of the other with surfaces in sliding relation for relative movement of the jaws toward and away from each other. The thickened portions of jaws 1 and 2 project in opposite direction from the surfaces so the nut gripping forces on the projections are balanced.

Sliding jaw 2 has a slot 2*c* slidably receiving the shank of shoulder pin 3 and a chamfer 2*f* corresponding to chamfer 1*f*.

Handle 5 has one or more teeth 5*a* meshing with teeth 2*d* on jaw 2 for moving sliding jaw 2 relative to pin 3 as permitted by slot 2*c* and a hole 5*c* receiving the shank of pin 4 to pivot the handle on jaw 1. The guide 2*b* is held against guide 1*b* by forces from teeth 5*a*.

Spring 6 has one end 6*a* seated in a hole 5*b* in handle 5 and the other end 6*b* seated in a hole 4*a* in the head of shoulder pin 4. Spring 6 biases the handle toward the closed position of jaws 1*a*, 2*a*. Spring 6 is a light spring which has no nut gripping action.

When the handle 5 is in position shown in FIG. 1, counterclockwise rotation of the handle about its pivot 4 causes nut clamping movement of the jaw 2*a* toward the jaw 1*a*, the clamping force being the nut turning force applied to the handle multiplied by the leverage or mechanical advantage from the pivotal movement of the handle, a first class lever. Clockwise rotation of the handle about pivot 4 from the nut clamping position, releases the clamping force and applies a spreading force to the jaw 2*a* relative to jaw 1*a* to permit ratcheting of the wrench to a new nut gripping position.

Figure 4:
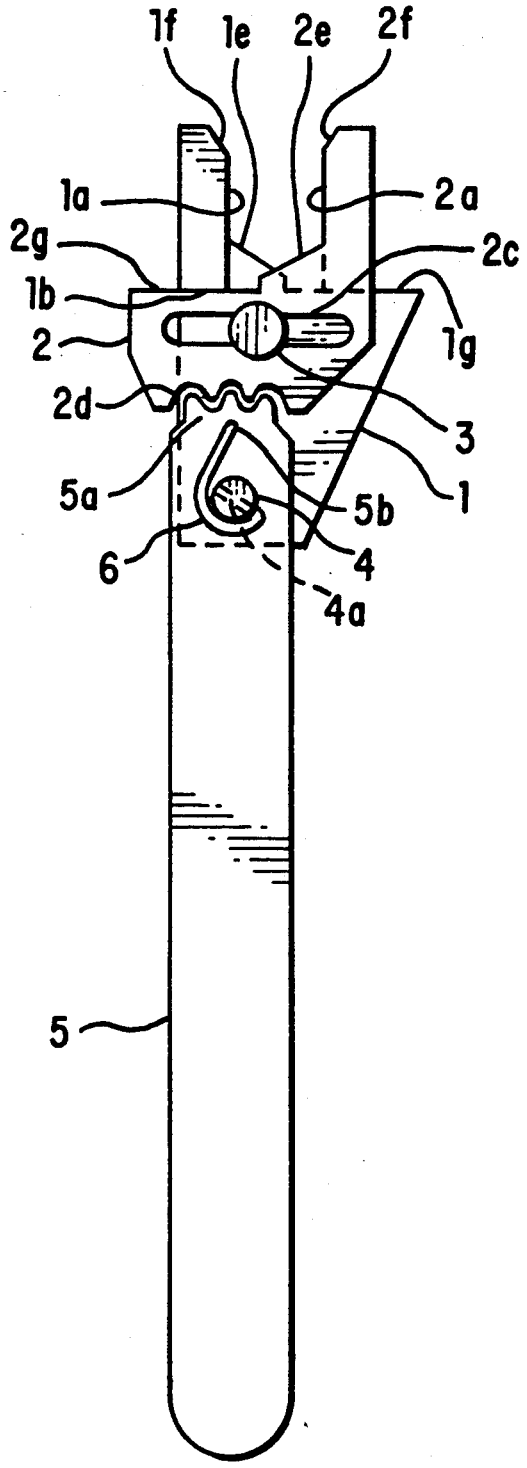
FIGS. 4 and 5 are plan and edge views of a modification.
Figure 5:
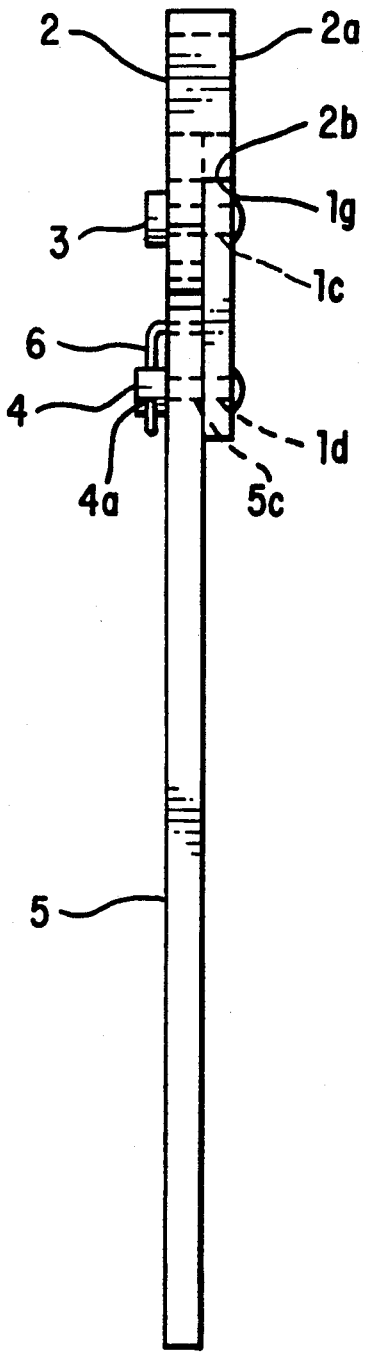
Figure 6:
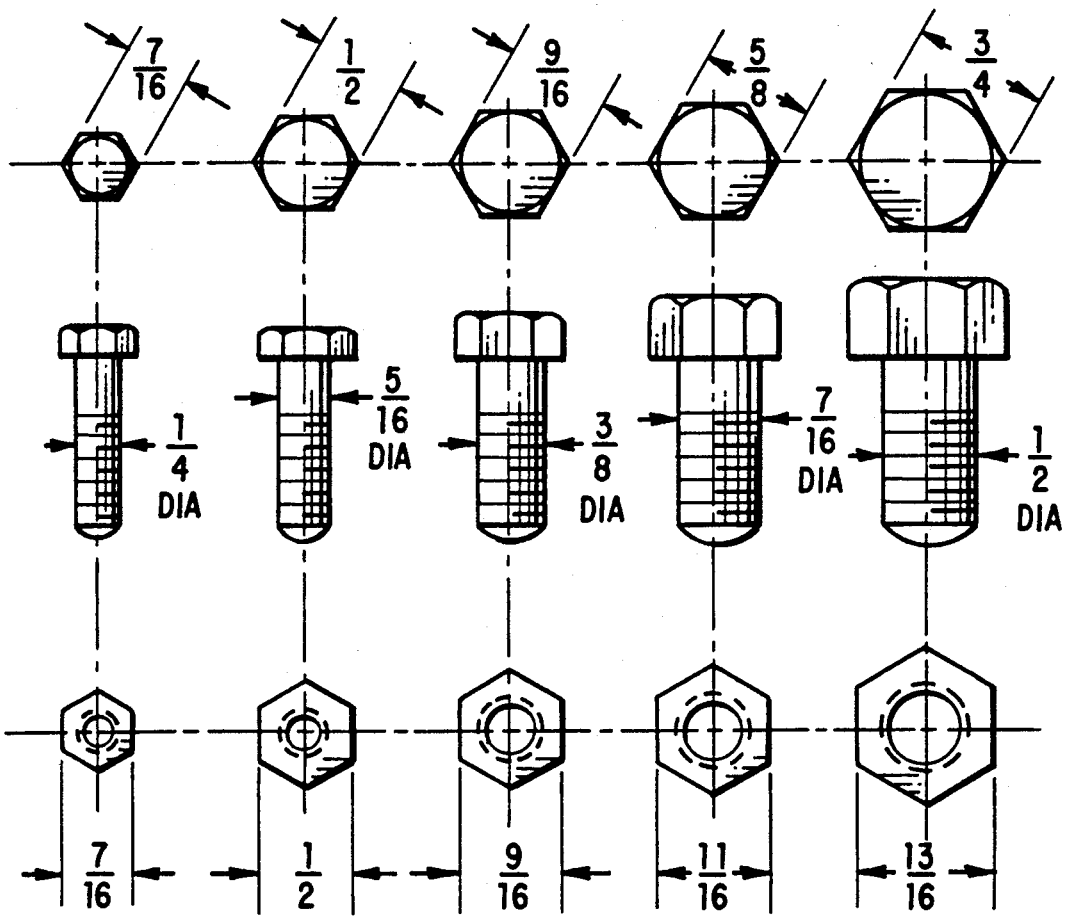
FIG. 6 is a chart of Metric and American Standard bolts and nuts.
Figure 6:
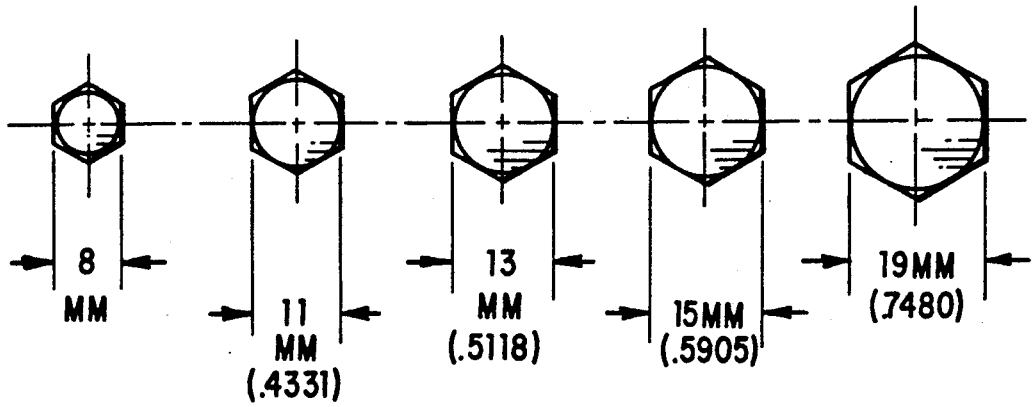

FIGS. 4 and 5 show a modification in which the handle and sliding jaw both have multiple teeth 5*a*, 2*d*.

Figure 7:
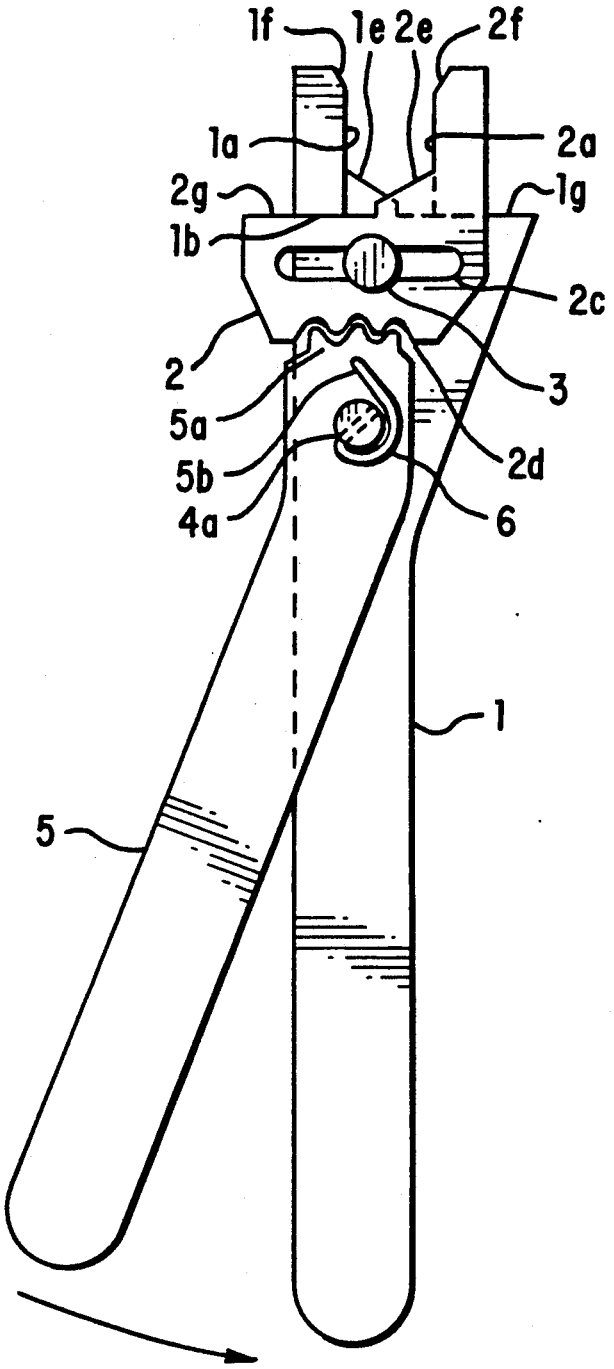
FIGS. 7 and 8 are plan and edge views of another modification.
Figure 8:
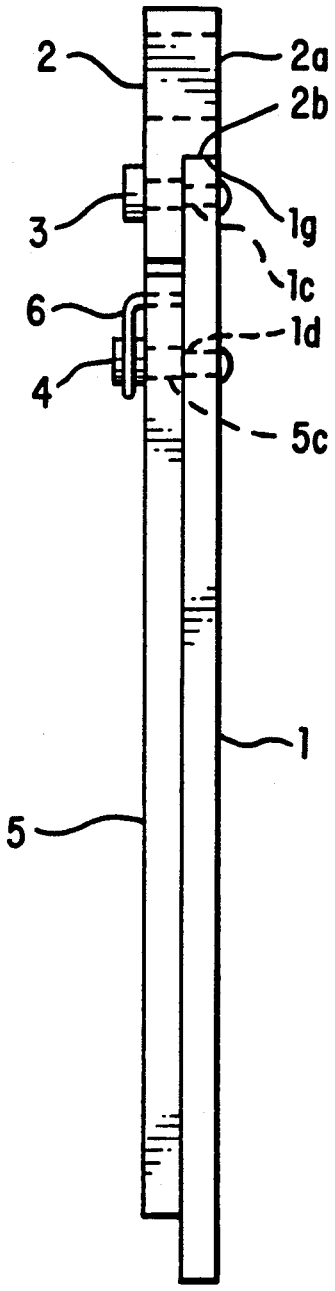

The modification of FIGS. 7 and 8 has the sliding jaw 2 biased by spring 6 to the open position and is manually closed against the nut by squeezing pressure between the handle 5 and extension 1*f* of main jaw 1. The squeezing force on the extension 1*f* causes counterclockwise pivoting (as viewed in FIG. 7) of the handle 5 about its pivot 4 and closing of the jaws 1*a*, 2*a* on the nut. The nut turning force applied to the handle in a counterclockwise direction also causes a leveraged nut clamping force which always exceeds the nut turning force exerted on the handle 5.

Figure 9:
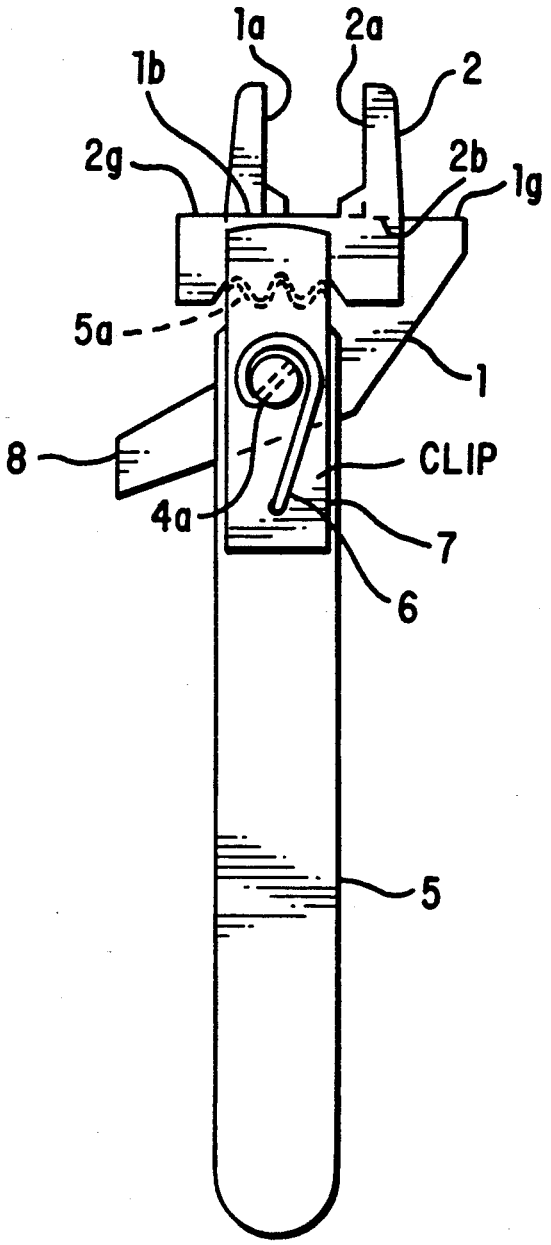
FIGS. 9 and 10 are plan and edge views of a modification omitting the pin and slot retainer between the jaws and FIG. 11 is an exploded view of the modification.
Figure 10:
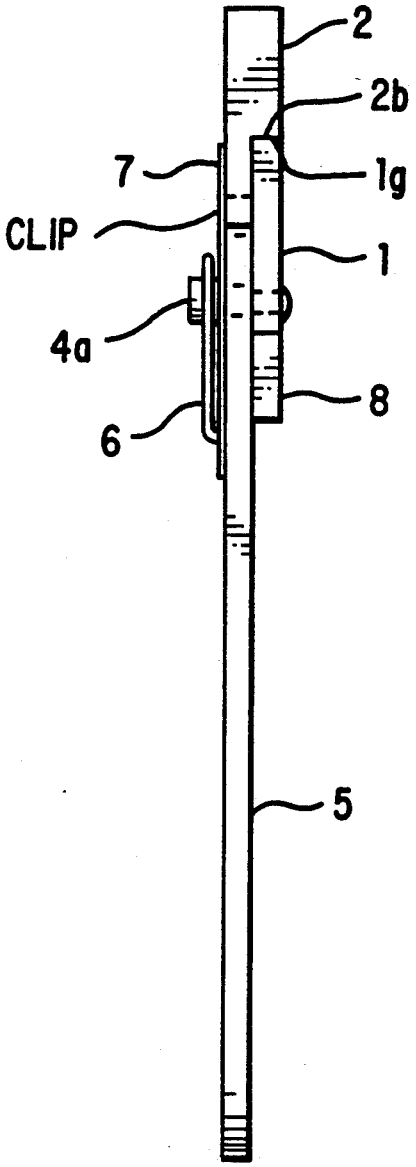
Figure 11:
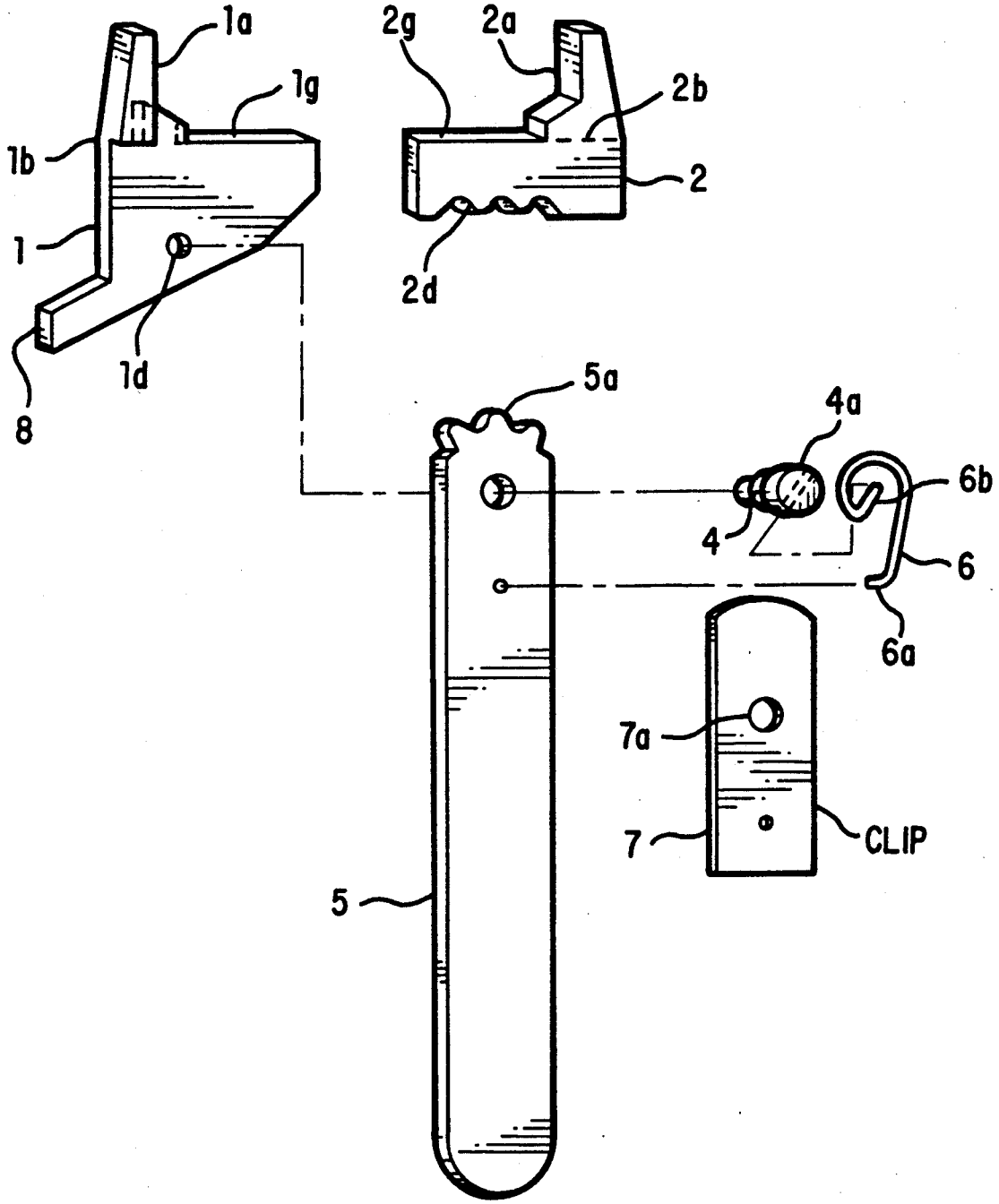

In the forms of the invention shown in FIGS. 1–8, the pin and slot connection 2*c*, 3 is a non-load carrying retainer which permits relative movement for opening and closing the jaws but does not enter into the nut tightening (or loosening) operation. Under load, there is clearance or daylight between the head of pin 3 and the jaw 2. In the modification of FIGS. 9–11, the pin and slot connection has been omitted. A rectangular washer 7 secured to the handle 5 by pin 4 which pivots the handle on jaw I serves as a non-load carrying retainer for preventing accidental disassembly of the parts when the wrench is not being used. The pin is inserted after the jaw 2 has been assembled on top of jaw 1 and positioned so teeth 5*a* on the handle mesh with teeth 2*d* on jaw 2. The assembly is completed by inserting one end 6*b* of spring 6 through hole 4*a* in the head of pin 4 and the other end 6*a* of the spring 6 through hole 7*a* in washer 7 and aligned hole 5*c* in the handle 5. The spring 6 does not enter into the nut gripping force. The spring 6 biases the handle 5 in the nut loosening direction. Thumb pressure on projection 8 on jaw 1 while holding the handle 5 assists in opening the jaws 1*a*, 2*a* to receive a bold head or nut.

In use, a bolt head or nut is gripped between jaws 1*a*, 2*a* and the gripping forces are taken through that part of surface 2*g* which engages surface 1*b* and through that part of surface 1*g* which engages surface 2*b*.

The nut gripping and turning forces hold the parts together.

In all forms of the invention, the spring 6 does not enter into the nut clamping action. The purpose of the spring 6 is to position the parts in a no-load position so that the user will more easily learn to use the wrench. The wrench has been described for loosening nuts. For tightening nuts, the wrench is inverted so that the tightening movement of the handle relative to the nut can be clockwise (nut tightening) instead of counterclockwise (nut loosening).

In addition to accomodating nuts of different sizes, the wrench provides a better grip on the nuts by eliminating clearance between the nuts and the nut gripping surfaces of the wrench.

I claim:

1. A self-adjusting open end ratchet wrench for use with nuts of multiple sizes comprising first and second generally flat jaw members which lie one on top of the other with surfaces engaging in sliding relation for relative movement of the jaws toward and away from each other, said jaws having opposed nut gripping surfaces which thickened portions which project in opposite directions from said engaging surfaces so the nut gripping forces on the projections are balanced, said first jaw having a guide surface 1*b* on its thickened portion presented to and engaging an edge guide surface 2*g* on said second jaw, said second jaw having a guide surface 2*b* on its thickened portion presented to and engaging an edge guide surface 1*g* on said first jaw, a handle pivoted between its ends to said first jaw, one end of the handle being adapted to receive a nut turning force and the other end of such handle having one or more teeth mating with corresponding teeth on said second jaw for moving the second jaw toward said first jaw to clamp a nut between the jaws, the pivot point of the handle being selected so that the force moving the second jaw toward such first jaw is always greater than the nut turning force applied to the handle, and non-load carrying retainer means for holding said jaws assembled and for permitting said relative movement.

2. The construction of claim 1 in which the retainer means is a pin and slot connection comprising a first pin fixed in said first jaw and extending through a clearance slot in said second jaw.

3. The wrench of claim 1 in which said jaws have opposed guides for relative movement of said jaws toward and away from each other.

4. The construction of claim 1 in which said first jaw has an extension with a hand grip portion spaced from the hand grip portion of said handle so that squeezing said hand grip portions effects said movement of the second jaw toward the first jaw to clamp a nut between the jaws.

5. The construction of claim 4 plus a spring means biasing the second jaw toward its open position.

6. The construction of claim 1 plus a spring means biasing the jaws toward the closed position of the jaws.

* * * * *